US009851121B1

(12) United States Patent
Oien

(10) Patent No.: US 9,851,121 B1
(45) Date of Patent: Dec. 26, 2017

(54) HEAT-ACTUATED FIRE DAMPER SEALING APPARATUS

(71) Applicant: Lynn Oien, Riviera Beach, FL (US)

(72) Inventor: Lynn Oien, Riviera Beach, FL (US)

( * ) Notice: Subject to any disclaimer, the term of this patent is extended or adjusted under 35 U.S.C. 154(b) by 0 days.

(21) Appl. No.: 15/353,399

(22) Filed: Nov. 16, 2016

(51) Int. Cl.

| | |
|---|---|
| ***A62C 2/12*** | (2006.01) |
| ***A62C 2/08*** | (2006.01) |
| ***F24F 11/053*** | (2006.01) |
| ***F24F 11/00*** | (2006.01) |
| ***F24F 13/15*** | (2006.01) |
| ***A62C 2/14*** | (2006.01) |
| ***A62C 2/24*** | (2006.01) |

(52) U.S. Cl.
CPC ..... *F24F 11/053* (2013.01); *A62C 2/14* (2013.01); *A62C 2/247* (2013.01); *F24F 11/0012* (2013.01); *F24F 13/15* (2013.01); *F24F 2011/0098* (2013.01)

(58) Field of Classification Search
CPC ..... Y10T 70/5646; Y10T 70/565; Y10T 70/5655; Y10T 70/5659; Y10T 70/5654
USPC ..... 454/369, 227–283, 221, 224, 309, 318, 454/342, 358; 70/182–189, DIG. 10; 292/DIG. 66
See application file for complete search history.

(56) References Cited

U.S. PATENT DOCUMENTS

| | | | | |
|---|---|---|---|---|
| 3,832,940 | A | 9/1974 | Hess | |
| 3,866,656 | A | 2/1975 | McCabe | |
| 3,899,156 | A | 8/1975 | McCabe | |
| 3,980,272 | A | 9/1976 | Nakai et al. | |
| 4,146,048 | A | 3/1979 | McCabe | |
| 4,241,748 | A | 12/1980 | McCabe | |
| 4,334,570 | A | 6/1982 | Adams | |
| 4,397,223 | A * | 8/1983 | Maxson | A62C 2/248 137/75 |
| 4,467,824 | A | 8/1984 | Strulik et al. | |
| 4,628,954 | A | 12/1986 | Dayus | |
| 4,711,193 | A | 12/1987 | Latza et al. | |
| 5,029,810 | A | 7/1991 | Finnerty | |
| 5,728,001 | A | 3/1998 | Attridge, Jr. | |
| 5,730,653 | A * | 3/1998 | Van Becelaere | A62C 2/14 454/237 |
| 2005/0031843 | A1 | 2/2005 | Robinson et al. | |

* cited by examiner

*Primary Examiner* — Avinash Savani
*Assistant Examiner* — Vivek Shirsat
(74) *Attorney, Agent, or Firm* — Dale J. Ream

(57) ABSTRACT

A heat activated sealing apparatus for closing and locking a plurality of ventilation damper blades of a ventilation framework includes a fire detection assembly for detecting a fire condition and an actuator. A damper closure assembly includes an axle in communication with the actuator of the fire detection assembly and operatively coupled to the plurality of dampers of the ventilation framework, the axle being selectively rotatable between a start configuration at which the plurality of ventilation dampers are at the open configuration and a deployed configuration at which the plurality of ventilation dampers are at the closed configuration. The damper closure assembly includes a locking assembly movable between an unlocked configuration allowing rotatable movement of the axle and a locked configuration not allowing rotatable movement of the axle. The locking assembly is movable to the locked configuration only when exposed to a predetermined amount of heat from the fire condition.

19 Claims, 17 Drawing Sheets

HEAT-ACTUATED FIRE DAMPER SEALING APPARATUS

BACKGROUND OF THE INVENTION

This invention relates generally to air handling equipment having dampers and damper sealing systems and, more particularly, to a heat-actuated fire damper sealing apparatus configured to close and lock a plurality of dampers automatically when a fire condition is detected.

In general, dampers are used to control the flow of air and may be used to regulate temperature and air flow to a room. Dampers allow for zone heating and cooling for the comfort of residents or workers. In addition, fire dampers may be positioned in ductwork as part of a fire control strategy. Dampers may be moved between open and closed positions manually, according to the setting of a thermostat, or as controlled by circuitry or programming.

Although presumably effective for their intended purposes, the existing devices and proposals do not detect a fire condition and then automatically actuate the mechanical closing of the dampers of a damper framework. Further, the prior art does not disclose an apparatus that provides a locking assembly that prevents a reverse rotation of a closing rod or reverse movement of a locking plate following a first operation after detection of the fire event.

Therefore, it would be desirable to have a heat-actuated fire damper sealing apparatus that actuates an axle to rotate and cause closure of a plurality of dampers when a fire condition is detected. Further, it would be desirable to have a heat-actuated fire damper sealing apparatus that prevents an unlocking of closed dampers even if the fire detection assembly and damper closure assembly are damaged or destroyed by fire.

SUMMARY OF THE INVENTION

A heat activated sealing apparatus according to the present invention is configured to close and lock a plurality of ventilation damper blades of a ventilation framework that are movable from an open configuration to a closed configuration when a fire event is detected. The sealing apparatus includes a fire detection assembly capable of detecting a fire condition. A damper closure assembly includes an axle having a proximal end in operative communication with the actuator of the fire detection assembly and a distal end operatively coupled to the plurality of dampers of the ventilation framework, the axle being selectively rotatable between a start configuration at which the plurality of ventilation dampers are at the open configuration and a deployed configuration at which the plurality of ventilation dampers are at the closed configuration.

The damper closure assembly includes a locking assembly slidably movable between an unlocked configuration allowing rotatable movement of the axle and a locked configuration not allowing rotatable movement of the axle. The locking assembly is movable to the locked configuration only when exposed to a predetermined amount of heat from the fire condition.

Therefore, a general object of this invention is to provide a heat-actuated fire damper sealing apparatus configured to close and lock a plurality of dampers automatically when a fire condition is detected.

Another object of this invention is to provide a heat-actuated fire damper sealing apparatus, as aforesaid, having a fire detection assembly for detecting a fire event, such as by sensing a sharp incline in temperature.

Still another object of this invention is to provide a heat-actuated fire damper sealing apparatus, as aforesaid, having a closure assembly in communication with the fire detection assembly and with the plurality of dampers and that is configured to mechanically close and lock the dampers.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
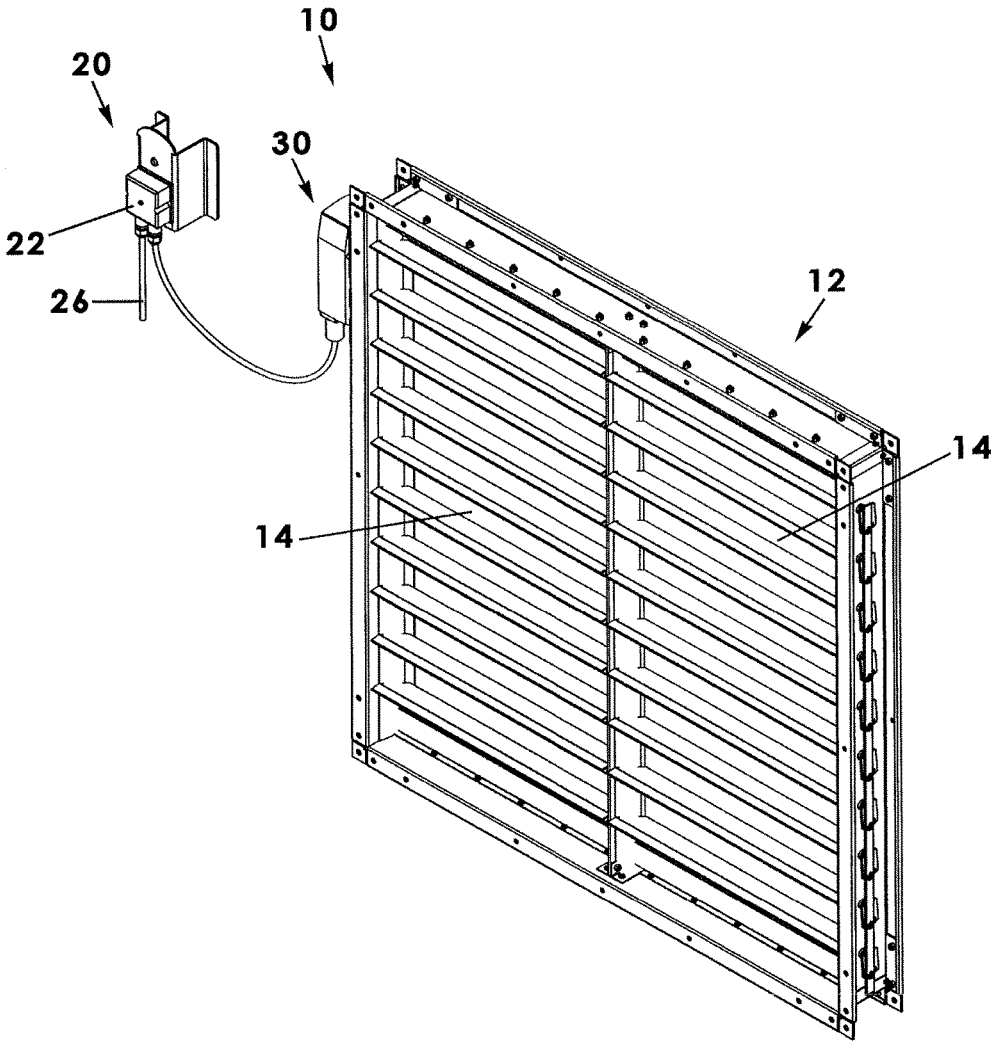
FIG. 1 is a perspective view of a heat activated damper sealing apparatus according to a preferred embodiment of the present invention, illustrated with a plurality of dampers in an open configuration.

A heat activated damper sealing apparatus according to a preferred embodiment of the present invention will now be described in detail with reference to FIGS. 1 to 13 of the accompanying drawings. The sealing apparatus 10 includes a fire detection assembly 20 for detecting a fire condition, a damper closure assembly 30 in communication with a framework 12 of dampers and that includes an axle 32 and a locking assembly 40.

A framework 12 having a plurality of dampers 14 may be positioned near the cabin of a custom boat, yacht, or the like and is useful for selective ventilation. The dampers 14 may be selectively opened or closed by a user according to his preference or may be closed and locked automatically upon detection of a fire condition as will be described below. It is understood that the plurality of dampers 14 are all interconnected, such as with rods, rack and pinion and gear components, or other suitable linkages. The linkage for opening or closing the dampers may be purely mechanical or, in an embodiment, be remotely controlled such as by radio signals.

The fire detection assembly 20 may include a detection housing 22 containing circuitry, electronic components, or even a processor (not shown). A temperature probe may extend away from the detection housing 22 that is configured to detect an ambient temperature indicative of a fire condition. In other embodiments (not shown), the fire detection assembly may include other means for detecting fire, such as a smoke detector, carbon monoxide detector, or a combination of all three types of detection means. The fire detection assembly 20 may include an electrical cord 26 in communication with an AC or battery power source.

The damper closure assembly 30 includes an actuator 28 in electrical communication with the fire detection assembly 20 and is configured to be energized when the fire detection assembly 20 detects a fire condition. The damper closure assembly 30 is configured to close a plurality of dampers 14 arranged in a damper framework 12 when a fire condition is detected. The actuator 28 may include a motor (not shown) in electrical communication with the power source as described above. Again, the actuator 28 is energized when the fire detection assembly 20 (i.e. temperature probe) detects a fire condition.

Figure 2:
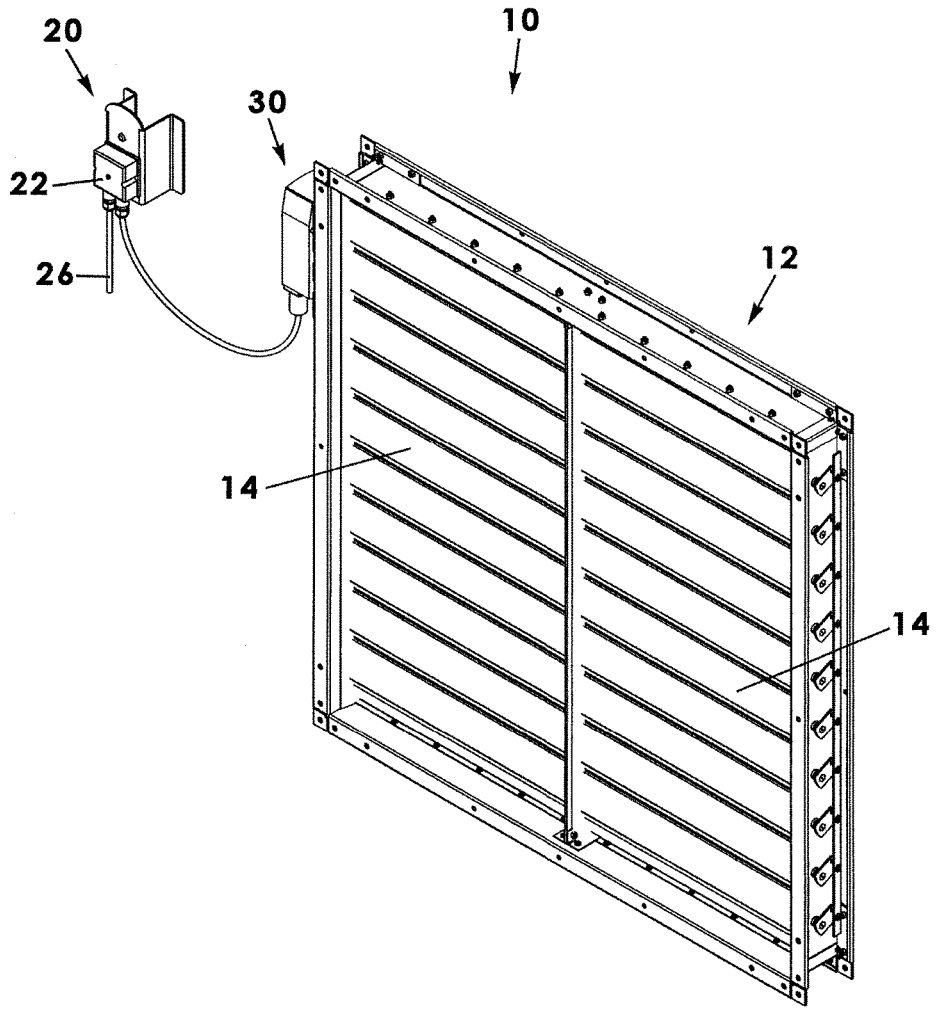
FIG. 2 is the sealing apparatus as in FIG. 1, illustrated with the plurality of dampers in closed configuration.
Figure 3:
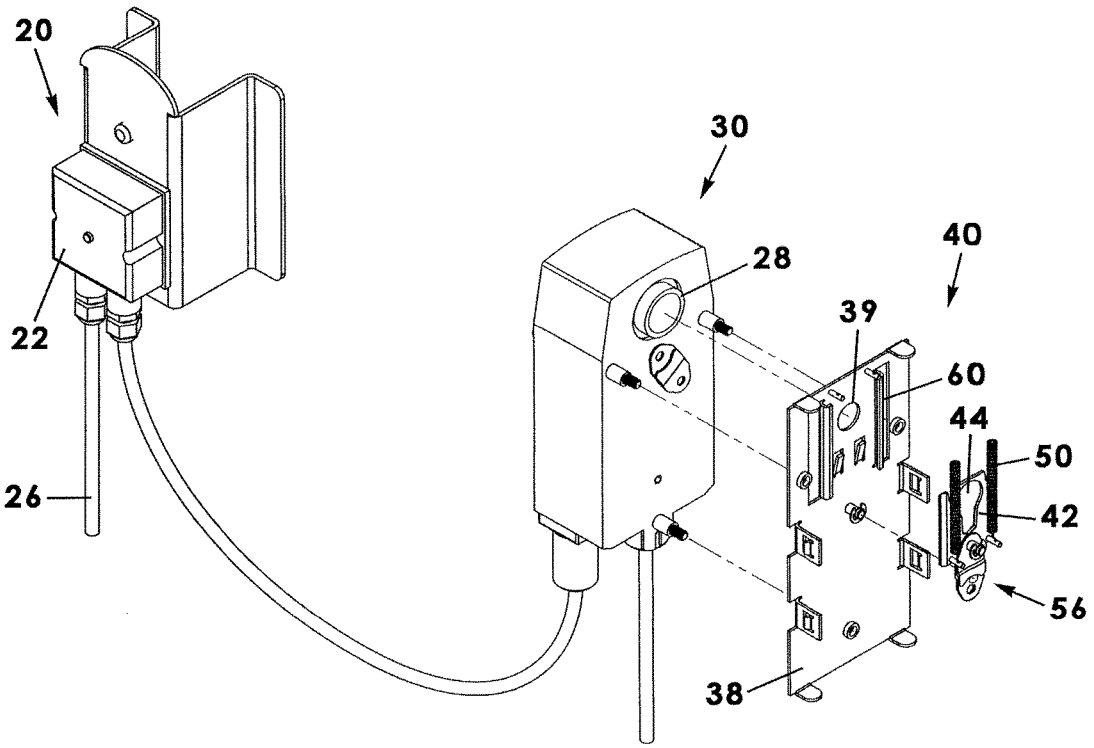
FIG. 3 is an exploded view of the sealing apparatus as in FIG. 1.

The damper closure assembly 30 includes an axle 32 having an elongate configuration and, in an embodiment, having a hexagonal or other irregular shaped configuration for reasons that will be discussed later. The axle 32 includes a proximal end 34 operatively coupled to the actuator 28 of the fire detection assembly 20 and a distal end 36 operatively coupled to the framework 12. When the actuator 28 is energized, the axle 32 is configured to rotate between a start configuration at which the plurality of dampers 14 is at an open configuration (FIG. 1) and a deployed configuration at which the plurality of dampers 14 is at a closed configuration (FIG. 2).

The damper closure assembly 30 includes a locking assembly 40 that is slidably movable between an unlocked configuration allowing rotatable movement of the axle 32 and an unlocked configuration not allowing movement of the axle 32. The locking assembly 40 is only movable to the locked configuration (preventing movement of the axle) once a fire condition has been detected and the axle 32 has been actuated to rotate and close the dampers 14 of the framework 12.

Now, more particularly, the locking assembly 40 may include a mounting plate 38 having a planar configuration that defines an aperture 39 proximate and adjacent an upper edge thereof, the aperture 39 being configured to receive the axle 32 therethrough. A locking plate 42 may be positioned adjacent the mounting plate 38 and defines an axle opening 44 aligned with the aperture 39 such that the axle 32 is configured to extend through the aperture 39 and axle opening 44. The axle opening 44 includes an upper section 46 having dimensions and a configuration that allows the axle 32 to rotate freely as described above and a lower section 48 that does not allow rotation of the axle 32. In other words, the axle 32 is captured and locked by the lower section 48. The axle 32 is especially prevented from movement when the axle has a hexagonal or other non-cylindrical configuration.

The locking assembly 40 further includes at least one tension spring 50 (and preferably a pair of spaced apart springs as illustrated in the drawings) having a first end 52 coupled to the mounting plate 38 adjacent the upper edge 42*a* and having a second end 54 coupled to the locking plate 42. The spring 50 (or springs) is normally biased to urge the locking plate 42 upwardly toward the first end of the spring 50 but is normally prevented from doing so by the second end attachment to the mounting plate 38. But when allowed to be urged upwardly, as will be described below, the lower section 48 is able to capture the axle 32 therein so as to prevent further rotation of the axle 32.

Further, the locking assembly 40 includes a locking flange 56 having an upper portion 57 coupled to the locking plate 42 and a lower portion 58 coupled to the mounting plate 38, the upper and lower portions being connected together with a temperature sensitive fastener, such as solder, that is severed (such as by melting) when exposed to a predetermined degree of heat. Accordingly, the spring 50 is prevented from urging the locking plate 42 upwardly into locking engagement with the axle 32 so long as the locking flange 56 is not severed.

The spring 50 is configured to pull the locking plate 42 upwardly and into engagement with the axle 32 and, as described above, is permitted to do this once the link (locking fastener 59) between the upper portion 57 and lower portion 58 of the locking plate 42 is severed, such as by the melting of a soldered connection. When urged upwardly, the lower section 48 of the locking plate 42 engages the axle in a tight friction fit or enveloped configuration that prevent any further rotation of the axle 32. The result of this action is that once the axle 32 has rotated so as to close the plurality of dampers 14 upon detection of a fire condition and heat from the fire condition causes a melting of the temperature sensitive fastener 59, the locking plate 42 is pulled upward to engage the axle 32 and prevent the dampers from being reopened.

In a related aspect, a pair of laterally spaced apart guide members 60 is configured to receive and guide the locking plate 42 when moving upwardly as described above. Each guide member 60 is mounted to the mounting plate 38 and oriented vertically. Further, each guide member 60 has a linear configuration that defines an inwardly open channel configured to receive a respective side edge 42*b* of the locking plate 42 therein so that the locking plate 42 can move slidably therealong when being urged upwardly.

Figure 4:
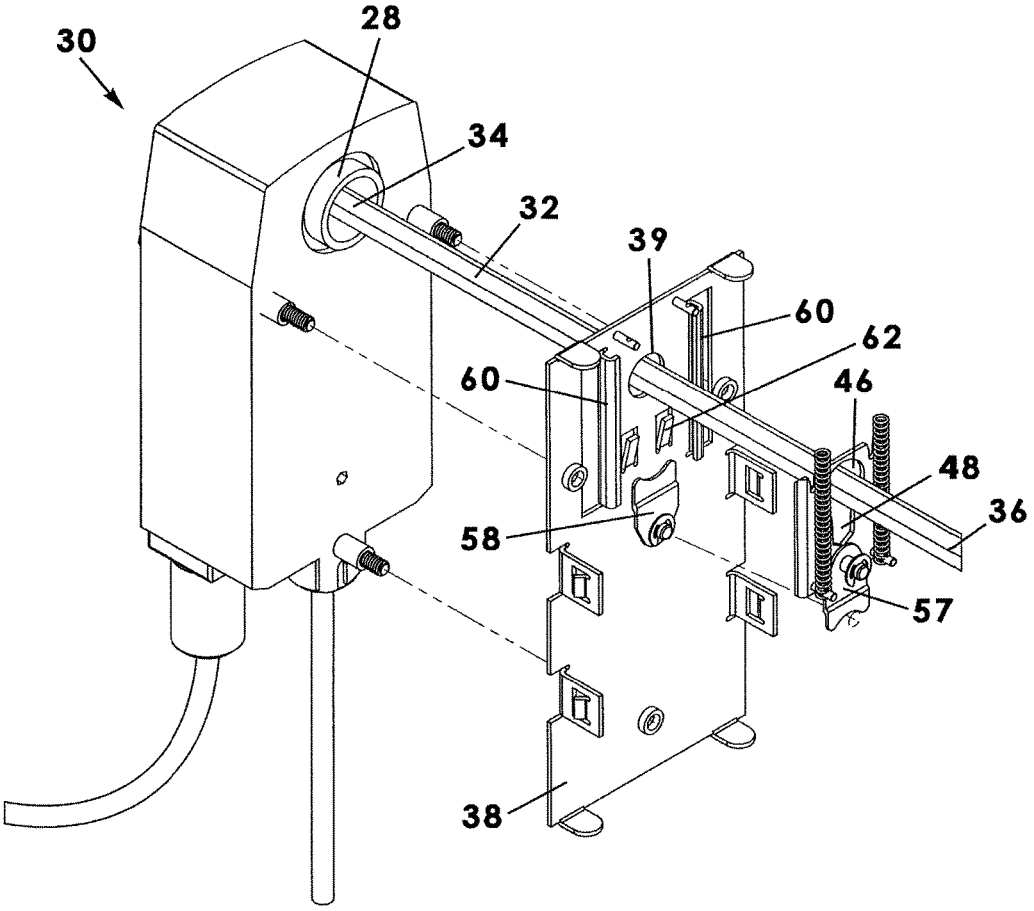
FIG. 4 is an exploded view of the damper closure assembly as in FIG. 3 illustrated with an axle extending through an upper portion of an axle opening of a locking plate.
Figure 5:
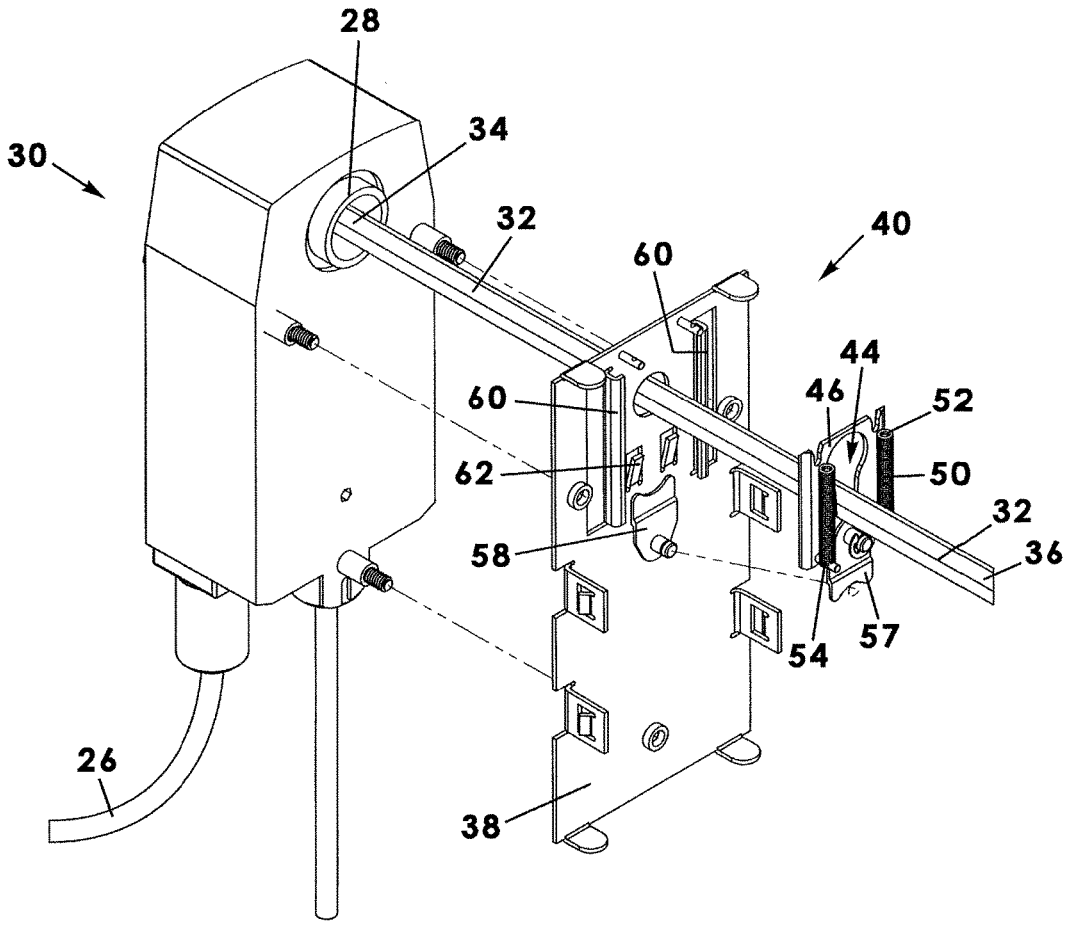
FIG. 5 is an exploded view of the damper closure assembly as in FIG. 3 illustrated with an axle extending through a lower portion of an axle opening of a locking plate.
Figure 6A:
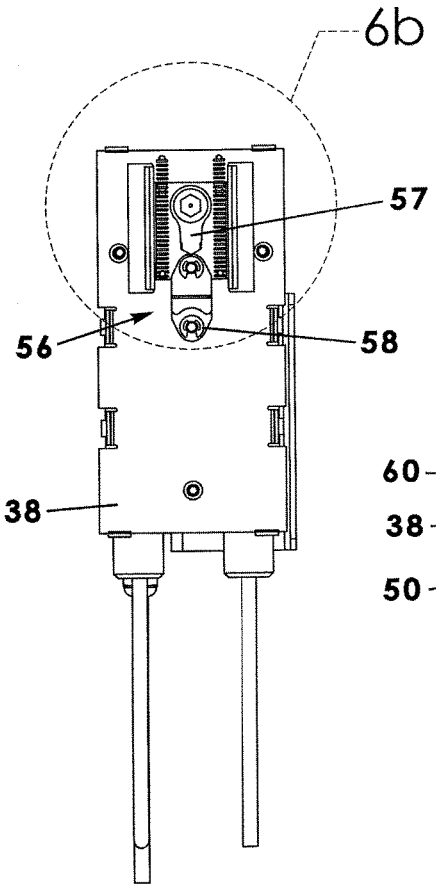
FIG. 6*a* is a rear view of the damper closure assembly coupled to the fire detection assembly as in FIG. 4.
Figure 6B:
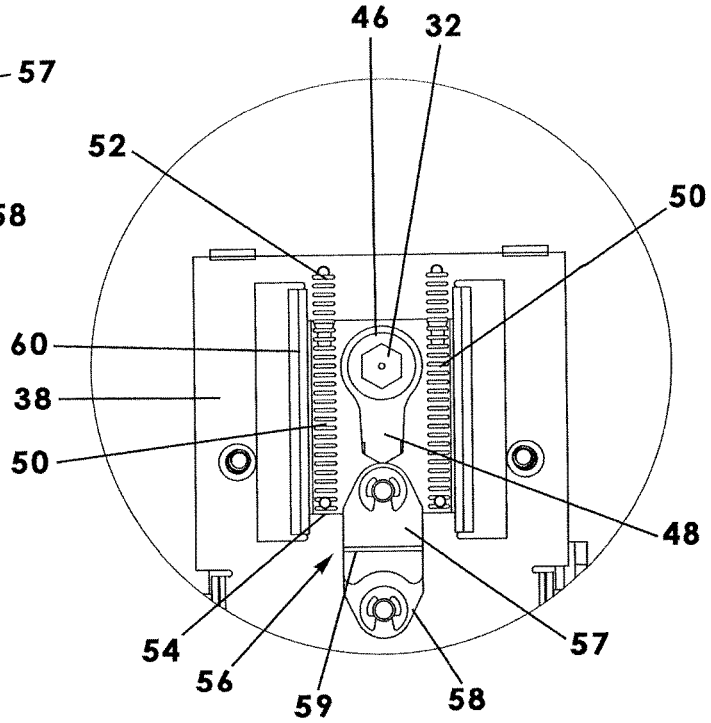
FIG. 6*b* is an isolated view on an enlarged scale taken from FIG. 6*a;*
Figure 7A:
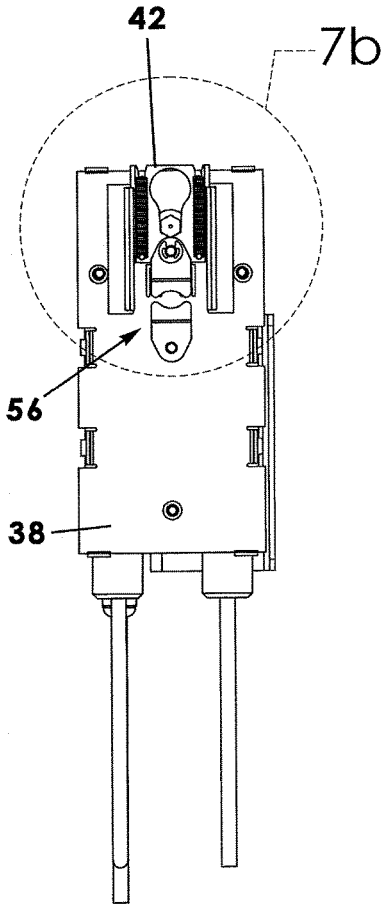
FIG. 7*a* is a rear view of the damper closure assembly coupled to the fire detection assembly as in FIG. 5.
Figure 7B:
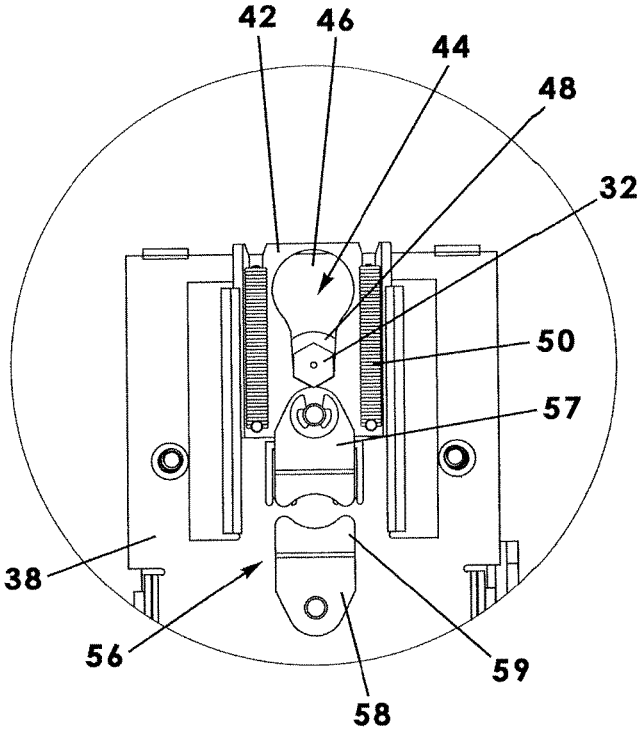
FIG. 7*b* is an isolated view on an enlarged scale taken from FIG. 7*a;*
Figure 8:
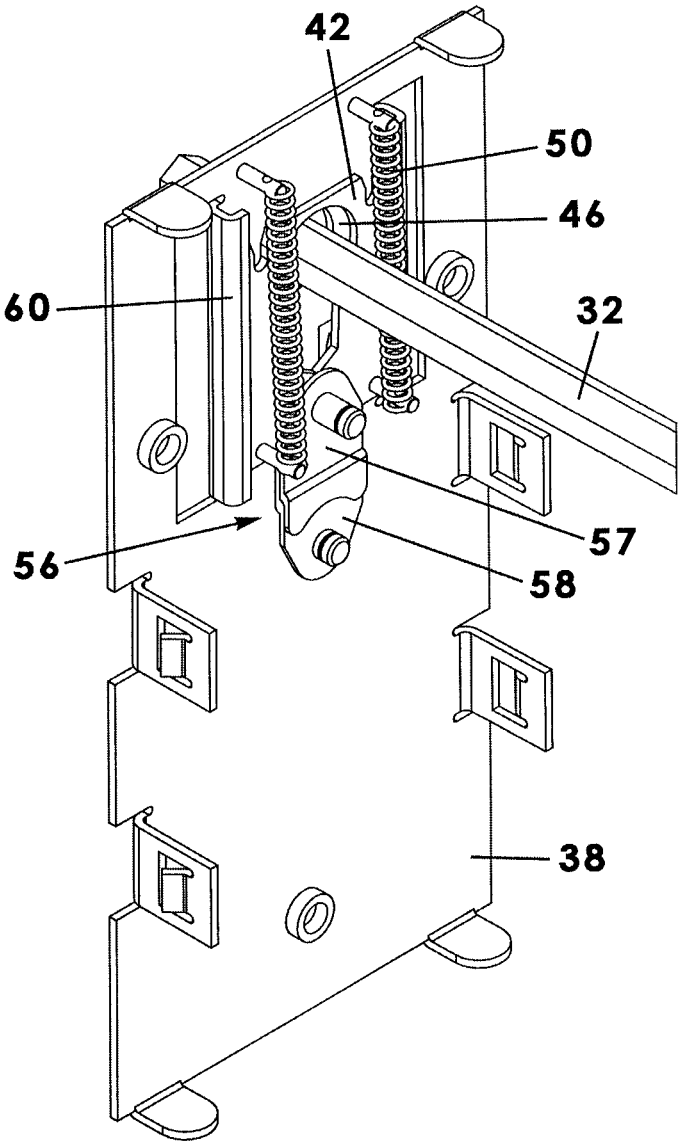
FIG. 8 is a perspective view of the mounting plate and related components removed from the exploded view of FIG. 4.
Figure 9A:
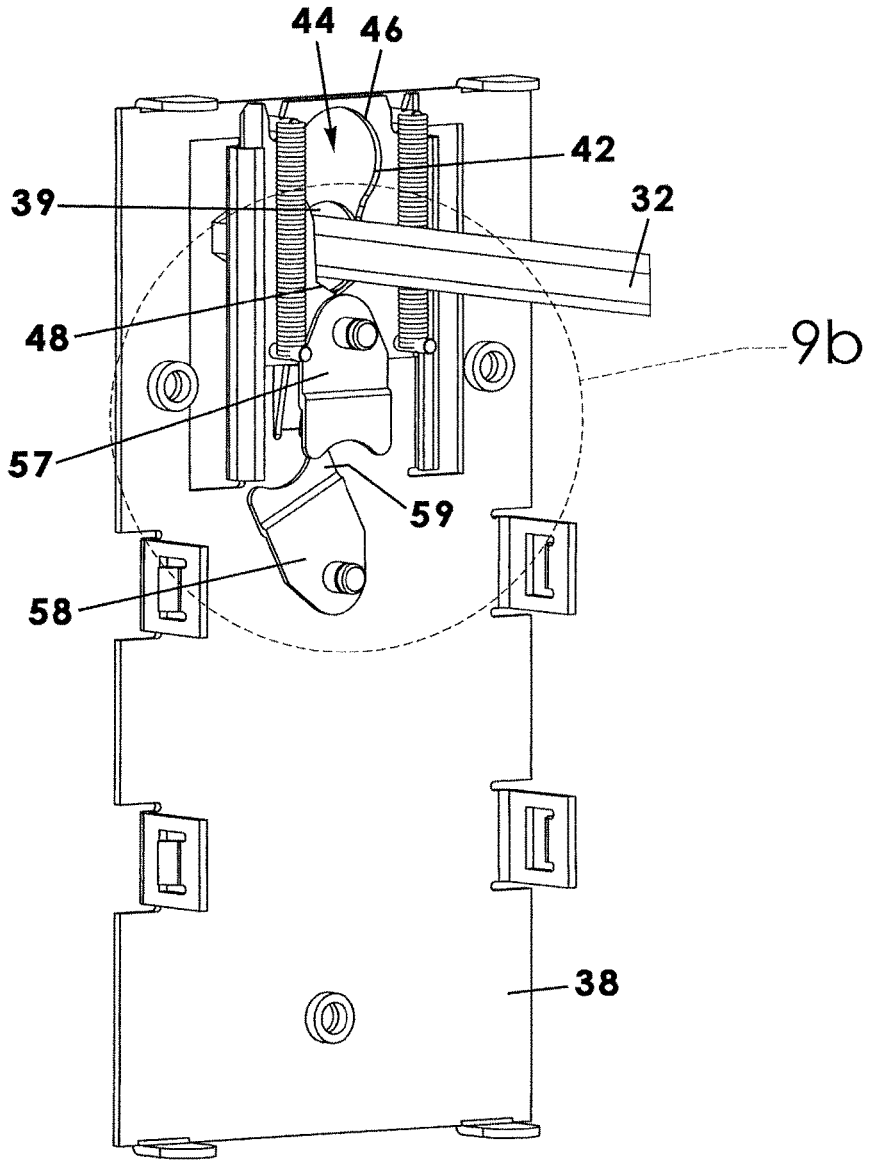
FIG. 9*a* is a perspective view of the mounting plate and related components removed from the exploded view of FIG. 5.
Figure 9B:
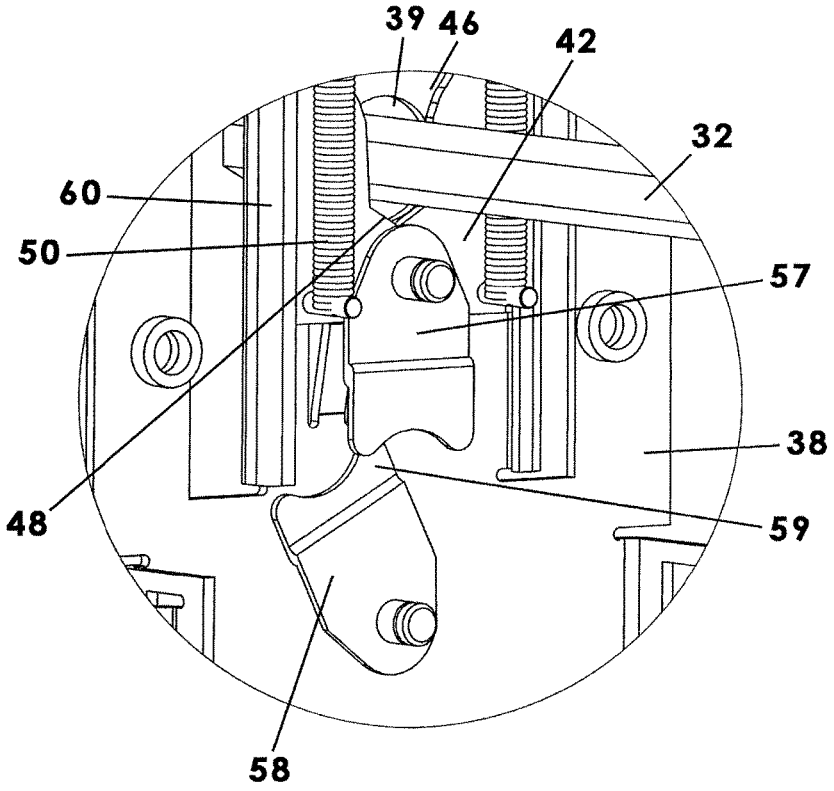
FIG. 9*b* is an isolated view on an enlarged scale taken from FIG. 7*a;*
Figure 10A:
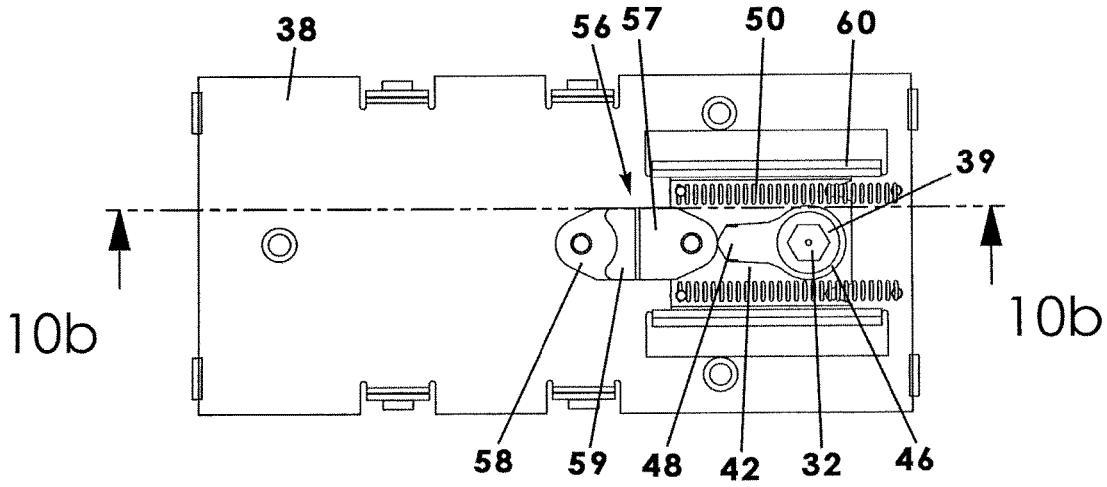
FIG. 10*a* is a front view of the closure assembly as in FIG. 8.
Figure 10B:
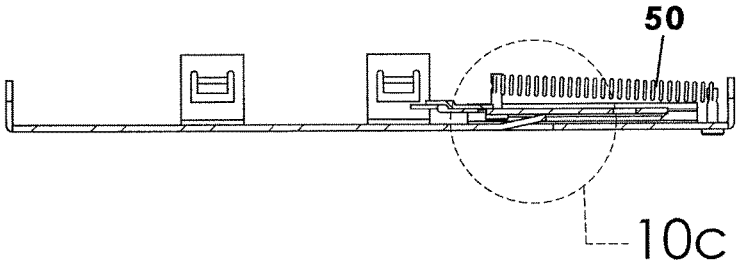
FIG. 10*b* is a sectional view taken along line 10-10*b* of FIG. 10*a;*
Figure 10C:
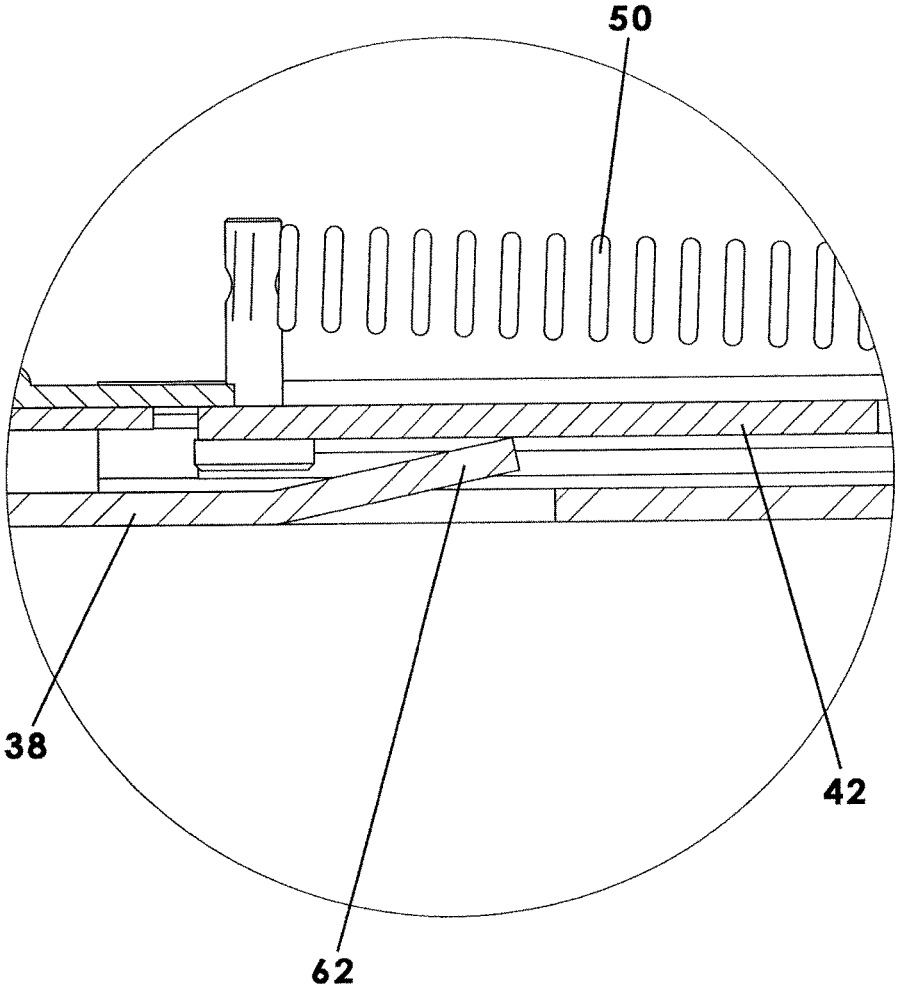
FIG. 10*c* is an isolated view on an enlarged scale taken from FIG. 10*b;*
Figure 11A:
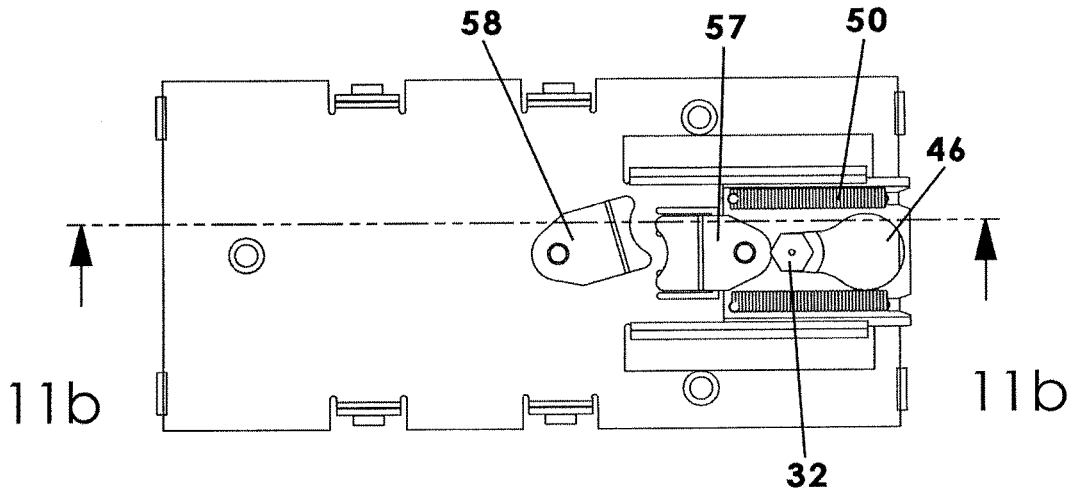
FIG. 11*a* is a front view of the closure assembly as in FIG. 9*a;*
Figure 11B:
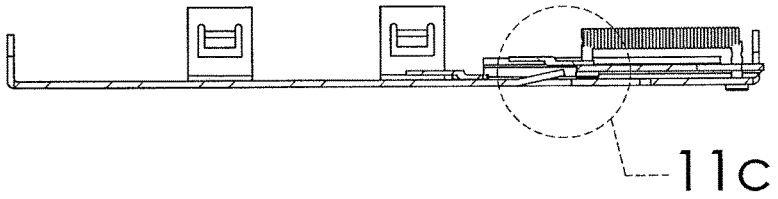
FIG. 11*b* is a sectional view taken along line 11-11*b* of FIG. 11*a;*
Figure 11C:
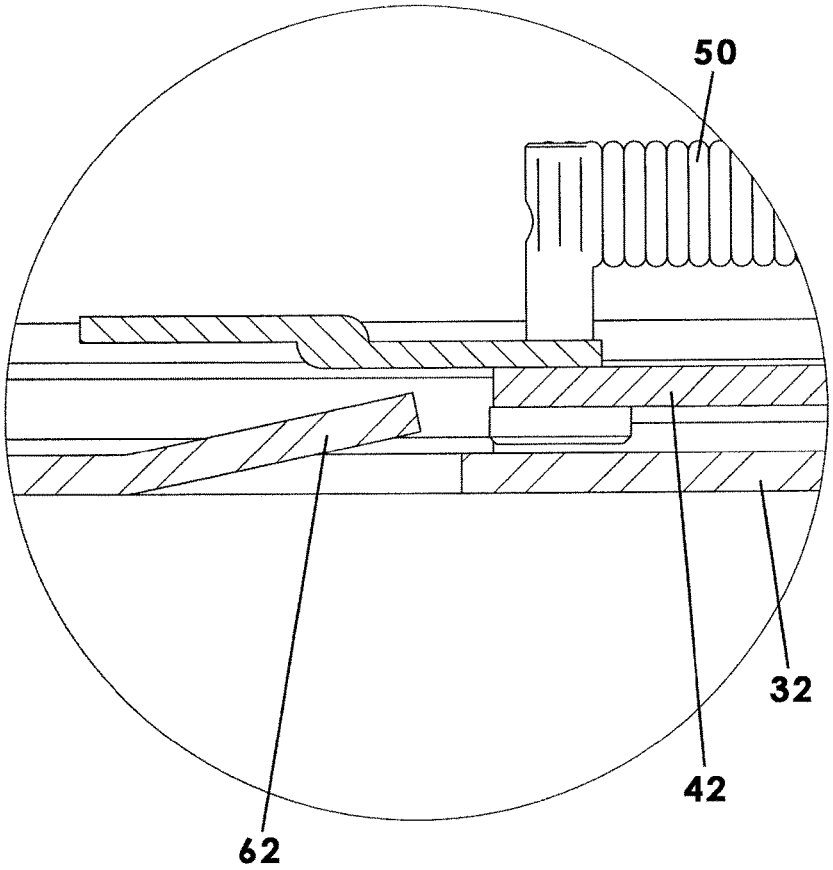
FIG. 11*c* is an isolated view on an enlarged scale taken from FIG. 11*b;*
Figure 12A:
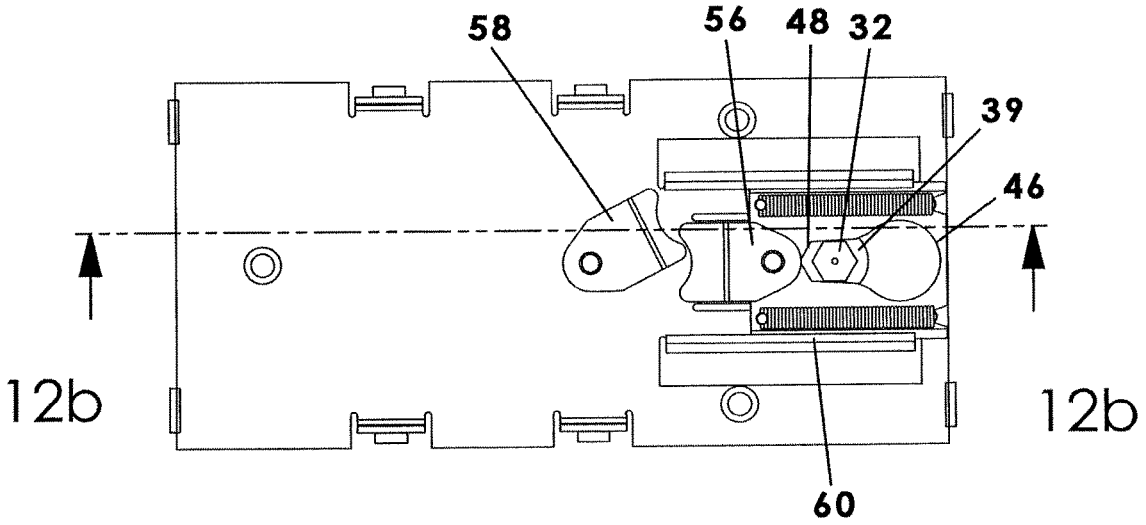
FIG. 12*a* is a front view of the closure assembly as in FIG. 9*a*, illustrated when the springs are urging the locking plate partially upwardly.
Figure 12B:
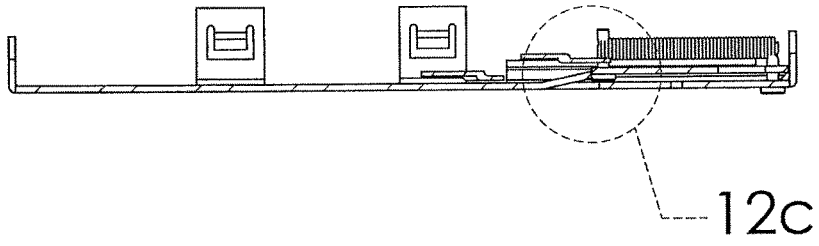
FIG. 12*b* is a sectional view taken along line 12-12*b* of FIG. 12*a*.
Figure 12C:
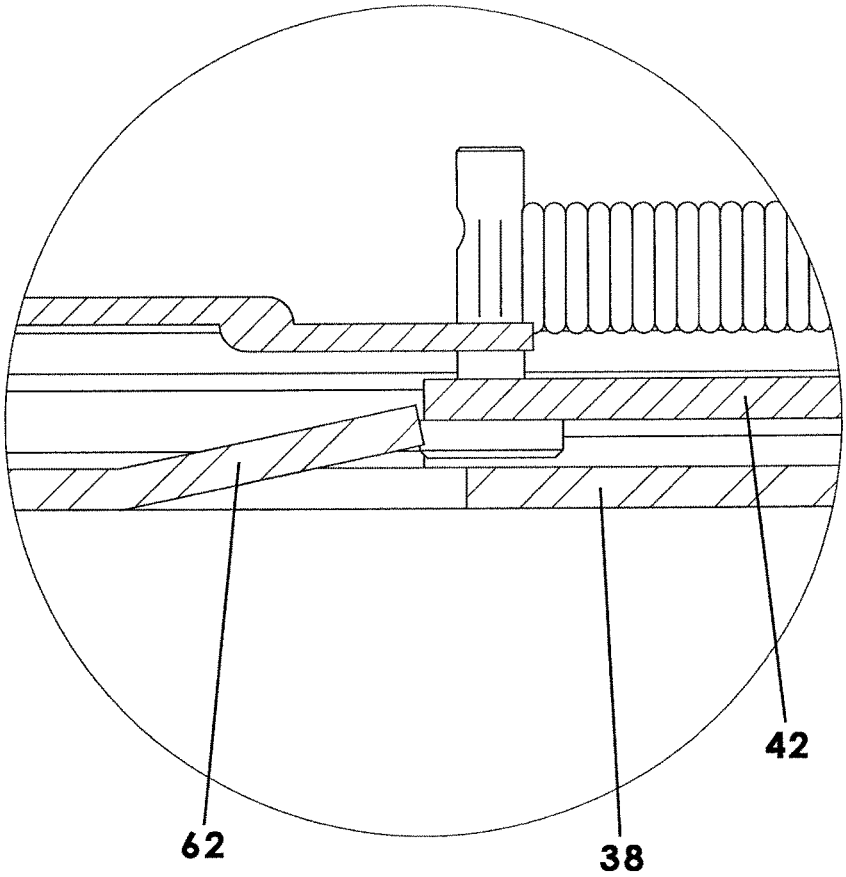
FIG. 12*c* is an isolated view on an enlarged scale taken from FIG. 12*b*.
Figure 13:
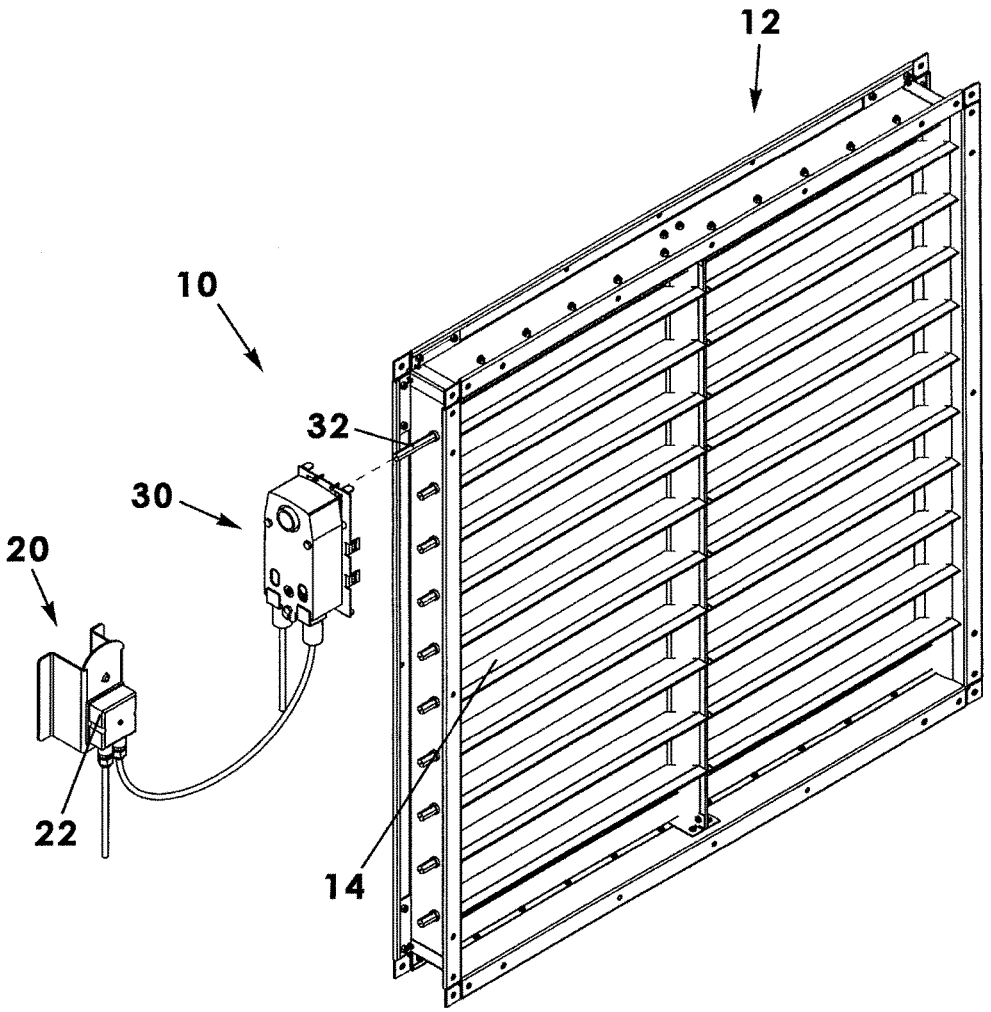
FIG. 13 is an exploded view of the sealing apparatus as in FIG. 1.

The locking assembly 40 also includes means for preventing the locking plate 42 from sliding or moving downwardly after it has first been urged upwardly by operation of the spring 50. In other words, once the axle 32 is prevented from rotating by engagement by the lower section 48 of the locking plate 42, there is an additional structure to prevent a relaxation of this engagement. More particularly, a stop member 62 (and, preferably, a pair of laterally spaced apart stop members) is coupled to the mounting plate 38 at a position downwardly displaced from the upper edge of the mounting plate 38 (FIG. 4). The stop member 62 extends upwardly and outwardly. When the locking plate 42 is urged upwardly by contraction of the spring 50 as described above, the stop member 62 serves as a ramp over which the locking plate 42 is allowed to move. But, then, once a lower edge of the locking plate 42 moves above the stop member 62, the stop member 62 acts as a shelf that prevents a downward movement of the locking plate 42 (FIG. 9*b*).

In use, the heat activated sealing apparatus 10 may be installed in a boat in proximity to and in communication with a framework 12 having a plurality of ventilation dampers 14. It is understood that it is desirable, upon sensing a fire condition, to close the dampers so as to maintain clear air within a cabin portion of the boat or simply to decrease or eliminate a flow of air to feed the flames. Accordingly, when the fire detection assembly 20 detects a fire event, such as via a temperature probe or smoke detector, the actuator 28 is energized to cause rotation of the axle 32, the axle 32 being operatively coupled to the dampers 14 of the framework 12.

The dampers 14 may thereby be moved to a closed or sealed configuration. Then, when the heat of the fire condition reaches a sufficient level, the soldered fastener 59 of the locking flange 56 will melt so as to sever the lower portion 58 from the upper portion 57. As described above, this enables the spring 50 to contract and urge the locking plate 42 upwardly—the lower section 48 of the axle opening 44 engaging and preventing further rotation (particularly preventing a reverse or opening type movement) of the axle 32. As a result, the dampers are locked in a sealed and closed configuration—even if the closure assembly itself becomes heavily damaged by the fire condition.

It is understood that while certain forms of this invention have been illustrated and described, it is not limited thereto except insofar as such limitations are included in the following claims and allowable functional equivalents thereof.

The invention claimed is:

1. A heat activated sealing apparatus configured to automatically close and lock a plurality of ventilation damper blades of a ventilation framework that are movable between an open configuration and a closed configuration when a fire event is detected, said heat activated sealing apparatus, comprising:

a fire detection assembly capable of detecting a fire condition;

a damper closure assembly including:

an actuator in electrical communication with said fire detection assembly so as to be energized when said fire detection assembly detects the fire condition;

an elongate axle having a proximal end in operative communication with said actuator and a distal end operatively coupled to the plurality of dampers of the ventilation framework, said axle being selectively rotatable between a start configuration at which the plurality of ventilation dampers are at the open configuration and a deployed configuration at which the plurality of ventilation dampers are at the closed configuration; and a locking assembly slidably movable between an unlocked configuration allowing rotatable movement of said axle and a locked configuration not allowing rotatable movement of said axle;

wherein said locking assembly is movable to said locked configuration only when exposed to a predetermined amount of heat from the fire condition;

wherein said locking assembly includes:

a mounting plate having a planar configuration and defining an aperture proximate an upper edge, said axle extending through said aperture;

a locking plate positioned adjacent said mounting plate and defining an axle opening aligned with said aperture such that said axle is configured to extend through said aperture and said axle opening, said axle opening including an upper section having dimensions that allow rotation of said axle and a lower section having dimensions that do not allow rotation of said axle;

wherein said locking plate is selectively vertically movable such that said either said upper section or said lower section is in communication with said axle.

2. The sealing apparatus as in claim 1, wherein said locking assembly includes:

a tension spring having a first end coupled to said mounting plate adjacent said upper edge and having a second end coupled to said locking plate;

wherein said spring is normally biased to urge said locking plate upwardly toward said first end of said spring;

wherein said spring is normally biased to urge said locking plate upwardly until said axle is captured by said lower section of said locking plate.

3. The sealing apparatus as in claim 2, wherein said locking assembly includes:

a locking flange having an upper portion coupled to said locking plate and a lower section coupled to said mounting plate, said upper and lower portion being connected together via a temperature sensitive fastener that is severed when exposed to a predetermined degree of heat;

wherein said spring is prevented from urging said locking plate upwardly so long as said locking flange is not severed.

4. The sealing apparatus as in claim 3, wherein said locking plate is automatically urged upwardly by contraction of said spring when said temperature sensitive fastener is severed such that lower section of said locking plate is in communication with said axle so as to prevent rotation thereof.

5. The sealing apparatus as in claim 1, wherein said mounting plate is coupled to a rear side of said fire detection assembly.

6. The sealing apparatus as in claim 1, wherein said locking assembly includes:

a pair of guide members spaced apart laterally and mounted vertically to said mounting plate, each guide member having a linear configuration and defining an inwardly open channel;

wherein each channel is configured to receive a respective side edge of said locking plate therein and to guide said respective edge when urged upwardly by said spring.

7. The sealing apparatus as in claim 1, wherein said locking assembly includes:

a stop member coupled to said mounting plate and displaced downwardly from said aperture, said stop member extending upwardly and outwardly from said mounting plate;

wherein said stop member is configured to allow said locking plate to move upwardly by contraction of said spring but not allow said locking plate to move downwardly after having first moved upwardly.

8. The sealing apparatus as in claim 1, wherein said fire detection assembly includes a temperature probe.

9. The sealing apparatus as in claim 1, wherein said axle includes a hexagonal cross sectional configuration that is capable of rotating freely when extending through said upper section of said locking plate and that is incapable of rotating when extending through said lower section of said locking plate.

10. A heat activated sealing apparatus configured to automatically close and lock a plurality of ventilation damper blades of a ventilation framework that are movable between an open configuration and a closed configuration when a fire condition is detected, said sealing apparatus, comprising:

a fire detection assembly capable of detecting the fire condition;

a damper closure assembly including:

an actuator in communication with said fire detection assembly and configured to be energized when said fire detection assembly detects the fire condition;

an elongate axle having a proximal end in operative communication with said actuator and a distal end operatively coupled to the plurality of dampers of the ventilation framework, said axle being selectively rotatable between a start configuration at which the plurality of ventilation dampers are at the open configuration and a deployed configuration at which the plurality of ventilation dampers are at the closed configuration; and a locking assembly slidably movable between an unlocked configuration allowing rotatable movement of said axle and a locked configuration not allowing rotatable movement of said axle; wherein said locking assembly includes:

a mounting plate having a planar configuration and defining an aperture proximate an upper edge, said axle extending through said aperture;

a locking plate positioned adjacent said mounting plate and defining an axle opening aligned with said aperture such that said axle is configured to extend through said aperture and said axle opening, said axle opening including an upper section having dimensions that allow rotation of said axle and a lower section having dimensions that does not allow rotation of said axle;

wherein said locking plate is selectively vertically movable such that said either said upper section or said lower section is in communication with said axle;

wherein said locking assembly is movable to said locked configuration only when exposed to a predetermined amount of heat from the fire condition.

11. The sealing apparatus as in claim 10, wherein said axle includes a hexagonal cross sectional configuration that is capable of rotating freely when extending through said upper section of said locking plate and that is incapable of rotating when extending through said lower section of said locking plate.

12. The sealing apparatus as in claim 10, wherein said locking assembly includes:

a tension spring having a first end coupled to said mounting plate adjacent said upper edge and having a second end coupled to said locking plate;

wherein said spring is normally biased to urge said locking plate upwardly toward said first end of said spring;

wherein said spring is normally biased to urge said locking plate upwardly until said axle is captured by said lower section of said locking plate.

13. The sealing apparatus as in claim 12, wherein said locking assembly includes:

a locking flange having an upper portion coupled to said locking plate and a lower section coupled to said mounting plate, said upper and lower portion being connected together via a temperature sensitive fastener that is severed when exposed to a predetermined degree of heat;

wherein said spring is prevented from urging said locking plate upwardly so long as said locking flange is not severed.

14. The sealing apparatus as in claim 13, wherein said locking plate is automatically urged upwardly by contraction of said spring when said temperature sensitive fastener is severed such that lower section of said locking plate is in communication with said axle so as to prevent rotation thereof.

15. The sealing apparatus as in claim 10, wherein said mounting plate is coupled to a rear side of said fire detection assembly.

16. The sealing apparatus as in claim 12, wherein said locking assembly includes:

a pair of guide members spaced apart laterally and mounted vertically to said mounting plate, each guide member having a linear configuration and defining an inwardly open channel;

wherein each channel is configured to receive a respective side edge of said locking plate therein and to guide said respective edge when urged upwardly by said spring.

17. The sealing apparatus as in claim 12, wherein said locking assembly includes:

a stop member coupled to said mounting plate and displaced downwardly from said aperture, said stop member extending upwardly and outwardly from said mounting plate;

wherein said stop member is configured and positioned to allow said locking plate to move upwardly by contraction of said spring but not allow said locking plate to move downwardly after having moved upwardly.

18. The sealing apparatus as in claim 10, wherein said fire detection assembly includes a temperature probe.

19. The sealing apparatus as in claim 10, wherein said locking assembly includes:

a tension spring having a first end coupled to said mounting plate adjacent said upper edge and having a second end coupled to said locking plate;

wherein said spring is normally biased to urge said locking plate upwardly toward said first end of said spring;

wherein said spring is normally biased to urge said locking plate upwardly until said axle is captured by said lower section of said locking plate; and a locking flange having an upper portion coupled to said locking plate and a lower section coupled to said mounting plate, said upper and lower portion being connected together via a temperature sensitive fastener that is severed when exposed to a predetermined degree of heat;

wherein said spring is prevented from urging said locking plate upwardly so long as said locking flange is not severed.

* * * * *